US009010256B2

(12) United States Patent
Brennan

(10) Patent No.: US 9,010,256 B2
(45) Date of Patent: Apr. 21, 2015

(54) KEYBOARD AND SLIDING AND SWIVELING MOUSE SUPPORT

(76) Inventor: Thaddeus Brennan, Monrovia, CA (US)

( * ) Notice: Subject to any disclaimer, the term of this patent is extended or adjusted under 35 U.S.C. 154(b) by 0 days.

(21) Appl. No.: 13/190,374

(22) Filed: Jul. 25, 2011

(65) Prior Publication Data

US 2013/0025506 A1 Jan. 31, 2013

(51) Int. Cl.
*A47B 21/03* (2006.01)

(52) U.S. Cl.
CPC ..... *A47B 21/0314* (2013.01); *A47B 2021/0321* (2013.01); *Y10S 248/918* (2013.01)

(58) Field of Classification Search
CPC ..... A47B 21/0314; A47B 2021/0321; A47B 2021/0328; A47B 2021/0335; A47B 2021/0342; A47B 21/035; A47B 2021/0364; A47B 21/0371; A47B 2021/0385; A47B 2200/009; G06F 3/021; G06F 3/0395
USPC ..... 248/918, 274.1, 276.1, 282.1, 284.1, 248/286.1, 285.1, 206.5, 309.4, 118.1, 248/118.5; 108/50.01, 92–94, 102–105, 108/139–142, 50.02; 312/223.3, 208.1; 361/379.08–379.2, FOR. 103, 361/FOR. 106; D14/457, 458, 459
See application file for complete search history.

(56) References Cited

U.S. PATENT DOCUMENTS 2,891,679 A * 6/1959 Maupin ..... 108/93
5,425,313 A * 6/1995 Rowan ..... 108/65
5,622,118 A * 4/1997 Rowan ..... 108/65
5,730,408 A * 3/1998 McAllister et al. ..... 248/288.51
5,771,814 A * 6/1998 Clausen ..... 108/93
5,832,840 A * 11/1998 Woof ..... 108/6
6,045,098 A * 4/2000 Timm ..... 248/118
6,079,676 A * 6/2000 Hackett et al. ..... 248/118
6,109,571 A * 8/2000 Hirschovits et al. ..... 248/118
6,247,672 B1 * 6/2001 Bello ..... 248/118.1
6,279,859 B2 * 8/2001 West et al. ..... 248/118
6,296,215 B1 * 10/2001 McCoy et al. ..... 248/284.1
D454,353 S * 3/2002 Hicks et al. ..... D14/457
6,390,432 B1 * 5/2002 VanderHeide et al. .. 248/346.01
D463,441 S * 9/2002 Benden et al. ..... D14/457
6,474,614 B2 * 11/2002 MacEachern ..... 248/349.1
6,505,566 B1 * 1/2003 Foster et al. ..... 108/138
6,644,605 B1 * 11/2003 Tyner ..... 248/118.1
6,659,416 B2 * 12/2003 Hicks et al. ..... 248/346.11
6,682,038 B2 * 1/2004 Golynsky ..... 248/346.01
6,688,563 B1 * 2/2004 Waxham et al. ..... 248/118.1
6,912,119 B2 * 6/2005 Maloney ..... 361/679.08
6,971,624 B2 * 12/2005 Kollar et al. ..... 248/274.1
7,293,751 B2 * 11/2007 Eriksson ..... 248/346.01
7,331,556 B1 * 2/2008 Brennan ..... 248/346.01
D588,145 S * 3/2009 Benden et al. ..... D14/457
7,568,774 B1 * 8/2009 Jannetides ..... 312/223.3
7,752,981 B2 * 7/2010 Blackburn ..... 108/93

(Continued)

*Primary Examiner* — Jonathan Liu
*Assistant Examiner* — Guang H Guan
(74) *Attorney, Agent, or Firm* — Karish & Bjorgum, PC

(57) ABSTRACT

A keyboard and mouse support having a keyboard platform with an elongate slide that extends laterally across the keyboard platform from left to right, the elongate slide having a left end and a right end, a mouse platform, a pivot that pivotally connects the mouse platform to the keyboard platform, which pivot slides and pivots in the elongate slide, and a radial position fixation mechanism for setting at least one radial position of the mouse platform with respect to the keyboard platform, and wherein the radial position fixation mechanism is located on both the left and right sides of keyboard platform.

6 Claims, 12 Drawing Sheets

(56) References Cited

U.S. PATENT DOCUMENTS

| | | | | |
|---|---|---|---|---|
| 8,272,600 | B2 * | 9/2012 | Copeland et al. | 248/118.5 |
| 2002/0117588 | A1 * | 8/2002 | Lando | 248/118 |
| 2005/0140187 | A1 * | 6/2005 | Kordecki | 297/162 |
| 2006/0109251 | A1 * | 5/2006 | Kelly | 345/168 |
| 2009/0057253 | A1 * | 3/2009 | Blackburn | 211/133.6 |
| 2009/0229089 | A1 * | 9/2009 | Galant | 24/303 |
| 2009/0301360 | A1 * | 12/2009 | Copeland et al. | 108/68 |
| 2013/0025506 | A1 * | 1/2013 | Brennan | 108/103 |
| 2013/0312644 | A1 * | 11/2013 | Copeland | 108/96 |

* cited by examiner

KEYBOARD AND SLIDING AND SWIVELING MOUSE SUPPORT

FIELD OF THE INVENTION

The invention relates generally to supports for a computer keyboard and mouse. More particularly, the present invention is a support for a computer keyboard and mouse that includes a keyboard support portion and a swiveling and sliding mouse support portion.

BACKGROUND OF THE INVENTION

Personal computers are widely used around the world both at work and in the home. Two major input devices used with computer system are its keyboard and mouse. The keyboard and mouse usually rests on the desk in close proximity to the computer monitor or screen. However, it is not uncommon for the desk or work surface of the computer system to be cluttered or be just too small to be functional. Furthermore, it is generally more ergonomic to have the keyboard and mouse placed at a position lower than the desktop about the position of the user's hand when the user's forearms are approximately parallel to the floor. Therefore, it is important to be able to adjust the location and position of the keyboard and/or mouse to provide greater space to work and to optimize ergonomics.

Although there are existing keyboard and mouse supports that allow for flexibility in positioning the keyboard and/or mouse to suit a user's ergonomic requirements, none of the prior art keyboard and mouse supports of which the inventor is aware disclose a device where the mouse platform and keyboard platform are not permanently connected to one another but wherein the mouse platform can be slidable and pivotally positioned relative to the keyboard platform as the user so desires. Further, none of the prior art of which the inventor is aware discloses a device where the mouse platform will have a plurality of preset angular positions relative to the keyboard platform.

By being able to position the mouse platform on either the left or right side of the keyboard platform, the mouse platform can accommodate left hand and right hand users. Additionally, by supplying a plurality of preset mouse platform axial positions relative to the keyboard platform, an ideal position of the mouse platform can be achieved.

Further, none of the prior art has disclosed a mouse platform that is slidably and pivotally connected to a keyboard platform that is attached to a height adjustment mechanism. By being able to adjust the height of the keyboard platform relative to a desk or table surface, and also adjust where the mouse support device is slidably connected on the keyboard platform, a user's ergonomic needs can be constantly satisfied, where a user feels the need to adjust the keyboard support and/or mouse support devices.

SUMMARY OF THE INVENTION

A keyboard and mouse support having a keyboard platform, a mouse platform, a pivot that pivotally connects the mouse platform to the keyboard platform, and a radial position fixation mechanism for setting at least one radial position of the mouse platform with respect to the keyboard platform.

A keyboard and mouse support having a keyboard platform with an elongate slide that extends laterally across the keyboard platform from left to right, the elongate slide having a left end and a right end, a mouse platform, a pivot that pivotally connects the mouse platform to the keyboard platform, which pivot slides and pivots in the elongate slide, and a radial position fixation mechanism for setting at least one radial position of the mouse platform with respect to the keyboard platform, and wherein the radial position fixation mechanism is located on both the left and right sides of keyboard platform.

DETAILED DESCRIPTION

Figure 1:
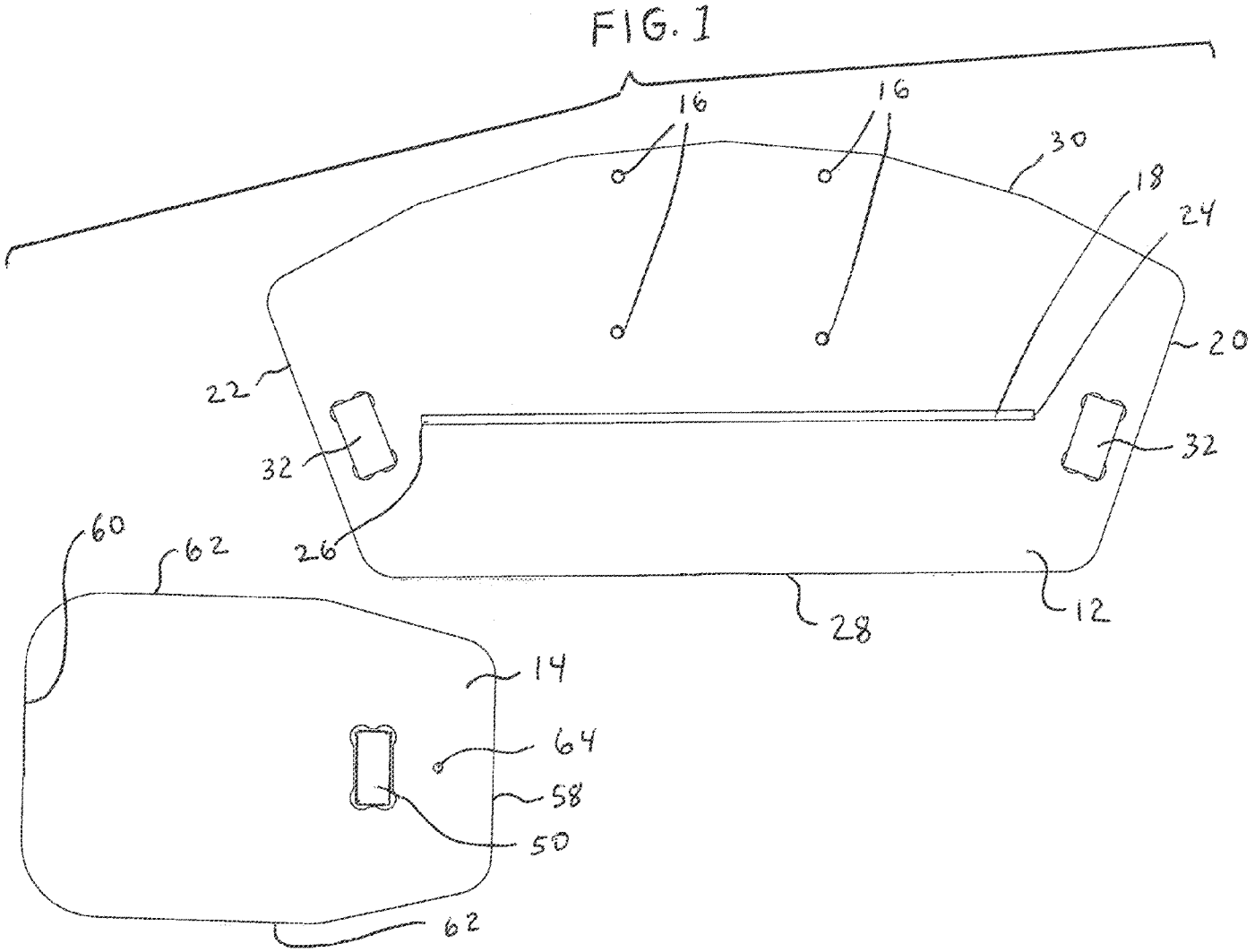
FIG. 1 is a top plan view of an exemplary embodiment of a keyboard platform and mouse platform that when assembled form a keyboard and sliding and swiveling mouse support of the invention.

The following detailed description and accompanying drawings are provided for the purpose of illustrating and describing presently preferred embodiments of the present invention and are not intended to limit the scope of the invention in anyway. It will be understood that various changes in the details, material arrangements of parts or operational conditions which have been herein described and illustrated in order to explain the nature of the invention may be made by those skilled in the art within the principles and scope of this invention.

Referring to the drawings, more particularly by reference numbers, FIGS. 1-6 show a first exemplary embodiment of a support 10 for a computer keyboard and mouse that includes a keyboard support portion 12 and a swiveling and sliding mouse support portion 14. FIGS. 7-11 shown a second exemplary embodiment of a support 10 for a computer keyboard and mouse that includes a keyboard support portion 12 and a swiveling and sliding mouse support portion 14.

FIG. 1 is a top plan view of an exemplary embodiment of the keyboard platform 12 and the mouse platform 14, that when assembled form the keyboard and sliding and swiveling mouse support 10 of the invention. The keyboard platform 12 comprises a generally flat section of material, such as high strength material, such phenolic laminate, particle board, medium-density fibreboard (MDF), or plastic. This material provides sufficient strength, even at thicknesses as thin as ¼" (6 mm). A benefit of this material is that the thickness of the device is reduced, and this permits the keyboard and mouse support to be lowered more relative to a thicker platform such as formed of wood, particleboard, or other weaker materials.

In order to permit the keyboard platform to be manipulated relative to a desktop or other surface via a keyboard arm (not shown), mounting holes 16 are preferably formed on the keyboard platform 12. Formed through the keyboard platform 12 is a longitudinal groove 18. The groove 18 extends across the width of the keyboard platform 12, from a right side 20 to a left side 22 thereof. The groove 18 has a right terminal end 24 and a left terminal end 26. The groove 18 is shown as being straight, but can follow other contours. The keyboard platform 12 has a front edge 28 and a rear edge 30. Although the rear edge 30 is shown as following a being generally curved or arched contour, it can be straight or follow other contours as desired. FIG. 1 shows metal plates 32 positioned in the keyboard platform 12 near the terminal ends 24 and 26 of the groove 18. For ease of description the metal plates 32 are revealed. However, as best shown in FIGS. 4-7, and particularly FIG. 7, the metal plates 32 are preferably retained in recesses 34 formed in a bottom surface 36 of the keyboard platform 12 so as not to extend outwardly therefrom. The metal plates 32 can be retained in the recesses 34 by adhesive 38 or can be mechanically attached, such as by screws, clips, or other known attachment devices (not shown). Although the metal plates 32 can be rectangular in shape, they can have other shapes if desired. The metal will preferably be a ferrous metal that attracts magnets. The mouse platform 14 comprises a generally flat section of material, such as high strength material, such phenolic laminate, particle board, medium-density fibreboard (MDF), or plastic. This material provides sufficient strength, even at thicknesses as thin as ¼" (6 mm). The mouse platform 14 is shown as being generally rectangular, but can have other shapes if desired, such as generally circular, teardrop shaped, or other shapes (not shown). A permanent magnet 50 is located in the mouse platform 14. As best shown in FIGS. 4-7, particularly FIG. 7, the magnet 50 is preferably retained in a recess 52 formed in an upper surface 54 of the mouse platform 14 so as not to extend outwardly therefrom. The magnet 50 can be retained in the recesses 52 by adhesive 56 or can be mechanically attached, such as by screws, clips, or other known attachment devices (not shown). In lieu of locating the metal plates 32 in the keyboard platform 12 and the magnet 50 in the mouse platform 14, magnets 50 can instead be placed in the keyboard platform 12 with a metal plate 32 located in the mouse platform 14. It is also possible that instead of using a magnet and metal plates, that magnets be placed in recesses in the keyboard platform aligned to attract the magnet 50 in the mouse platform 14. If this is the case, the two magnets will be aligned N-S or S-N so that they attract each other. The mouse platform 14 has an inside edge 58, an outside edge 60, and two opposed side edges 62. A pivot 64 is located on the mouse platform 14 between the magnet 50 and the inside edge 58. The pivot 64 can comprise a hole formed through the mouse platform 14, and can be sized to receive a sliding and pivoting fitting 70. As best shown in FIGS. 4-7, and particularly FIG. 7, the sliding and pivoting fitting 70 can comprise a barrel bolt 72 with a sliding head 74 and internally threaded boss 76, and a screw 78 with a head 80 and a male threaded shank 82 that is engaged with the internally threaded boss 76 of the barrel bolt 72. A plastic bushing 84 can be provided. The sliding and pivoting fitting 70 will allow the mouse platform 14 to both pivot in the groove 18 relative to keyboard platform 12, and also be moved from the left to the right side of the groove 18.

Figure 8:
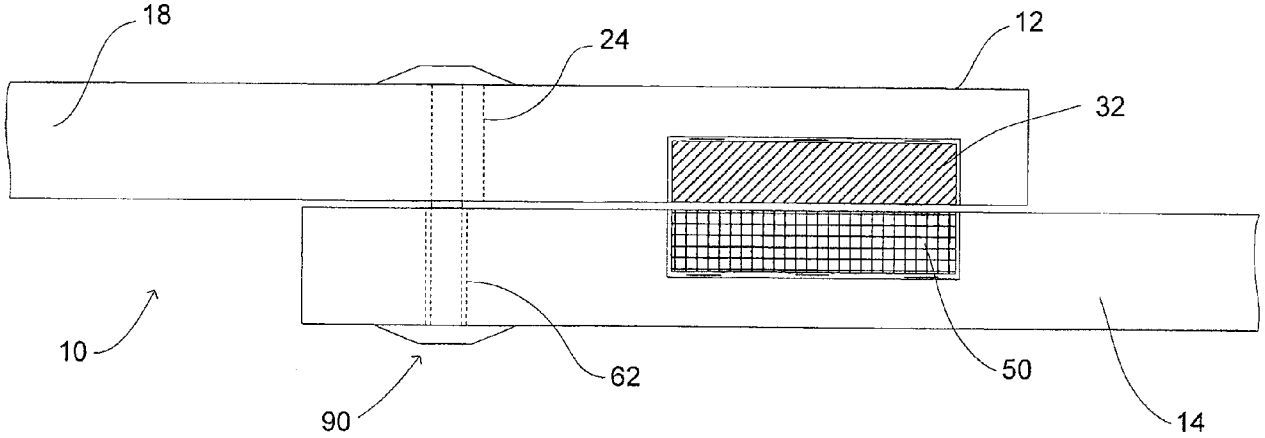
FIG. 8 is a detail showing the magnet, metal plate, and another embodiment of a sliding pivot holding the keyboard platform and mouse platform together.
Figure 9:
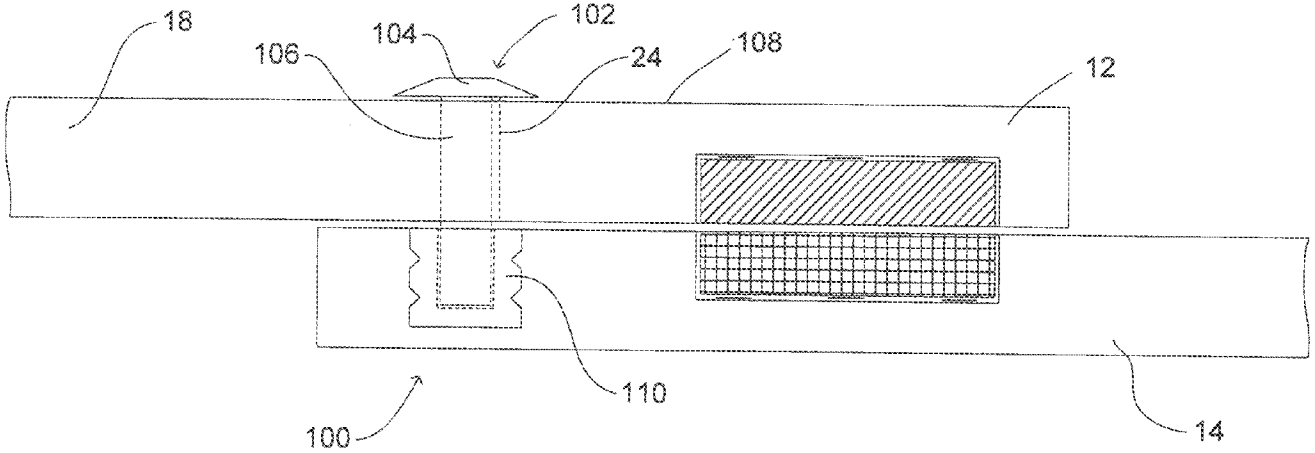
FIG. 9 is a detail showing the magnet, metal plate, and a further embodiment of a sliding pivot holding the keyboard platform and mouse platform together.

Although the sliding and pivoting fitting 70 is shown as a barrel bolt 72 and screw 78, as shown in FIG. 8, it can alternatively comprise a rivet 90 that is received in the hole 63 in the mouse platform 14 that slides and pivots in the groove 18. Turning to FIG. 9, there is shown an alternate embodiment of a sliding and pivoting fitting 100 which comprises a screw 102 with a head 104 and threaded shank 106. The head 104 sits on a top surface 108 of the keyboard platform 12 and the threaded shank 106 passes through the groove 18 and threads into a threaded fitting 110 located in the mouse platform 14.

Figure 10:
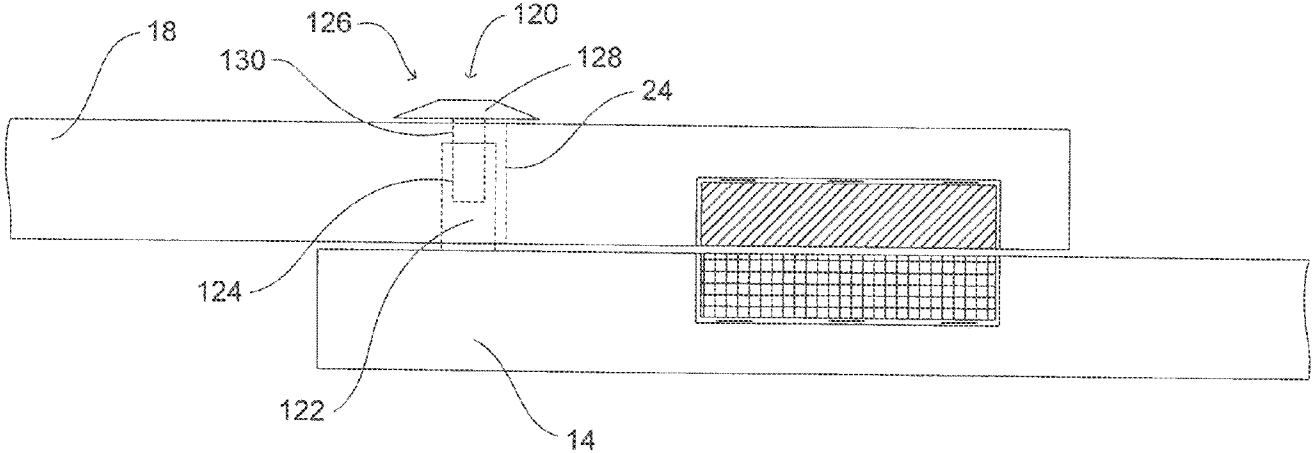
FIG. 10 is a detail showing the magnet, metal plate, and yet another embodiment of a sliding pivot holding the keyboard platform and mouse platform together.

Turning to FIG. 10, the sliding and pivoting fitting 120 can comprise a protrusion 122 with an internally threaded opening 124 extending upwardly from upper surface 54 of the mouse platform 14. A screw 126 with a head 128 and externally threaded shank 130 is screwed into the internally threaded opening 124, and the protrusion 122 and the screw 126 will slide and pivot in the groove 18 with the protrusion 122 and the screw 126 shown in the rightmost position adjacent to the rightmost end 24 of the groove 18. Other known structures can function as the sliding and pivoting fitting.

Figure 2:
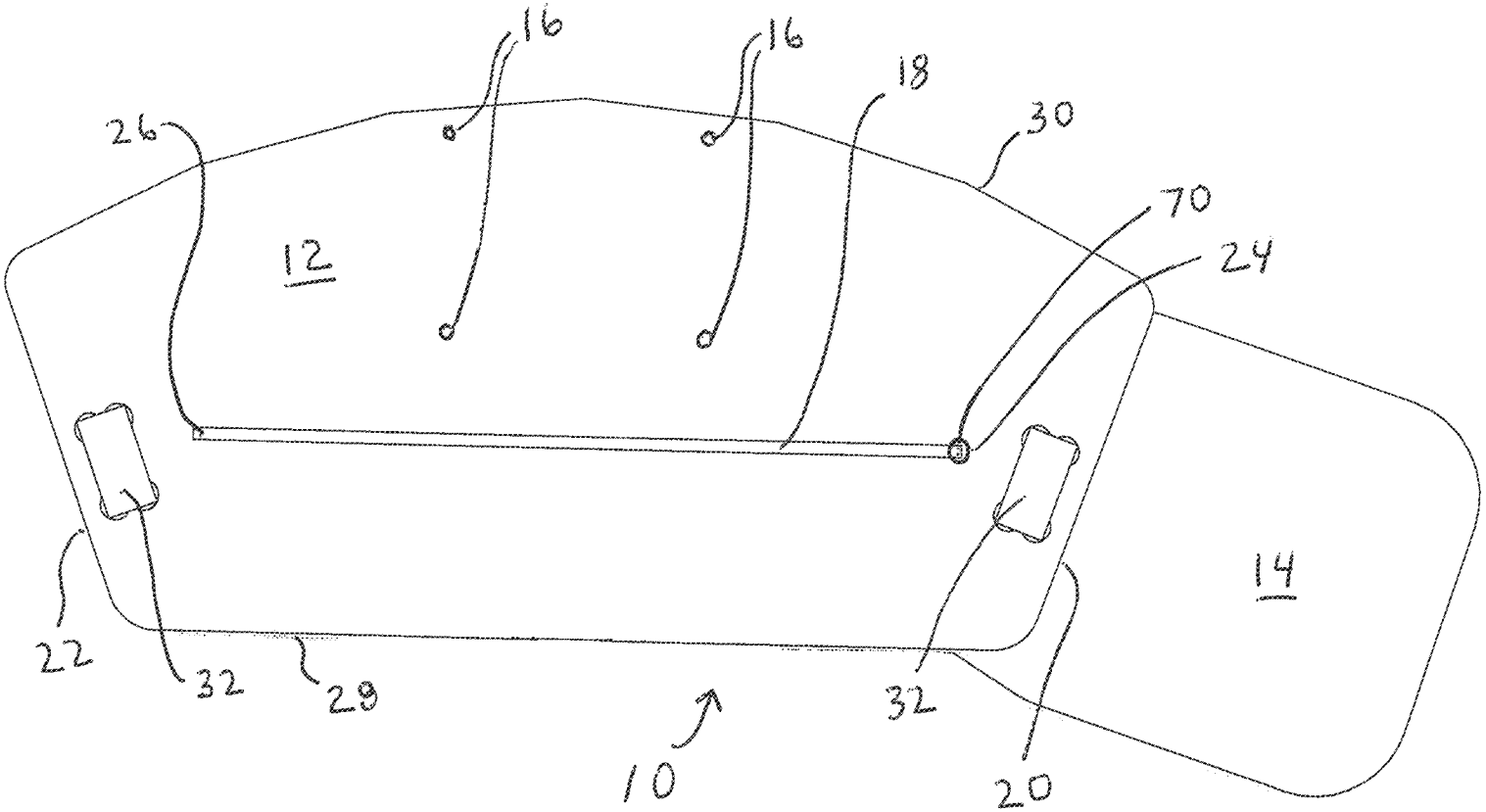
FIG. 2 is a top plan view of the assembled exemplary embodiment of the keyboard and sliding and swiveling mouse support of FIG. 1 with the mouse platform positioned on the right side of the keyboard platform.

Turning to FIG. 2, there is shown a top plan view of the assembled exemplary embodiment of the keyboard and sliding and swiveling mouse support 10 of FIG. 1 with the mouse platform 14 positioned on the right side of the keyboard platform 10. In this position, the sliding fitting 70 is adjacent to the right end 24 of the groove.

Figure 3:
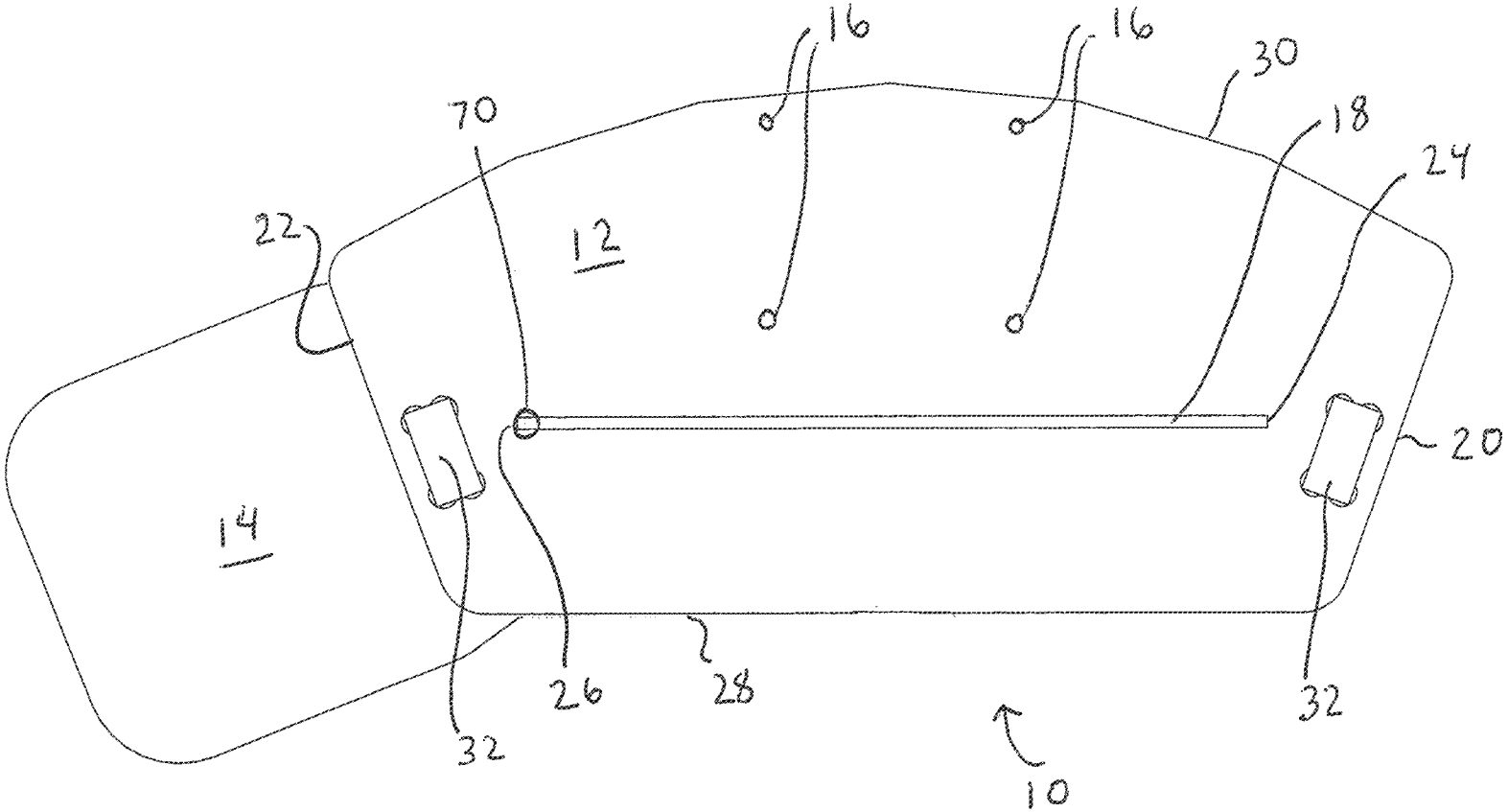
FIG. 3 is a top plan view of the assembled exemplary embodiment of the keyboard and sliding and swiveling mouse support of FIG. 1 with the mouse platform positioned on the left side of the keyboard platform.
Figure 4:
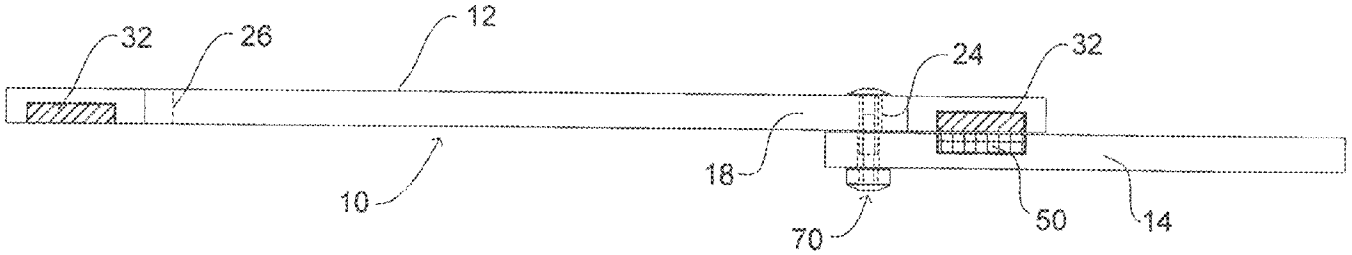
FIG. 4 is a front partially exposed view showing the exemplary embodiment of the keyboard and sliding and swiveling mouse support of FIG. 1 with the mouse platform positioned on the right side of the keyboard platform and showing the metal plate and magnet positioned in the keyboard platform and mouse platform, respectively, in their aligned position.
Figure 5:
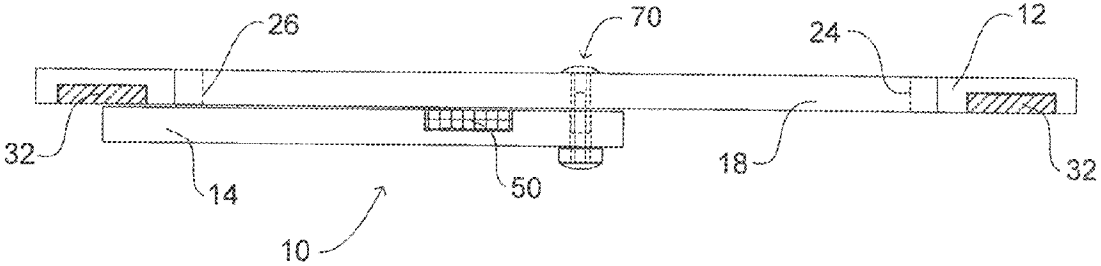
FIG. 5 is a front partially exposed view showing the exemplary embodiment of the keyboard and sliding and swiveling mouse support of FIG. 1 with the mouse platform being slid over from the right side of the keyboard platform towards the left side of the keyboard platform.
Figure 6:
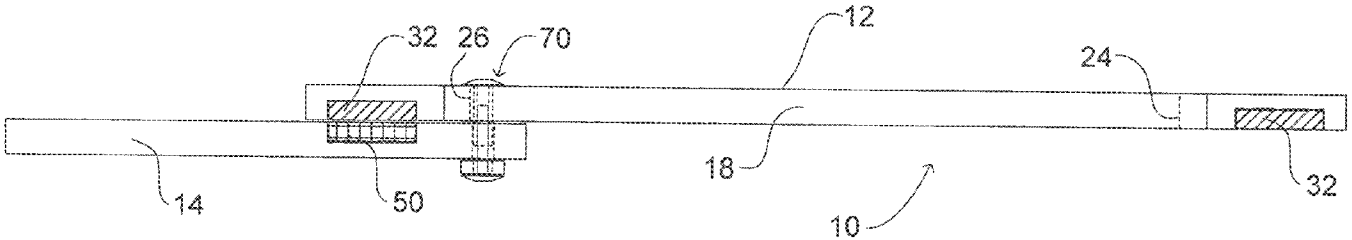
FIG. 6 is a front partially exposed view showing the exemplary embodiment of the keyboard and sliding and swiveling mouse support of FIG. 1 with the mouse platform positioned on the left side of the keyboard platform and showing the metal plate and magnet positioned in the keyboard platform and mouse platform, respectively, in their aligned position.
Figure 7:
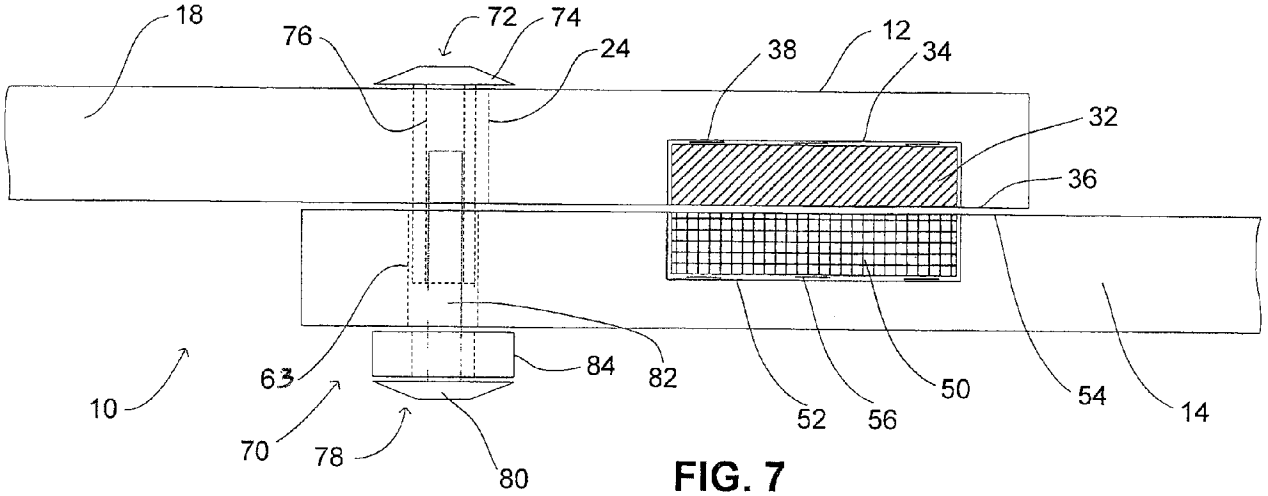
FIG. 7 is a detail showing the magnet, metal plate, and one embodiment of a sliding pivot holding the keyboard platform and mouse platform together.

FIG. 3 is a top plan view of the assembled exemplary embodiment of the keyboard and sliding and swiveling mouse support 10 of FIG. 1 with the mouse platform 14 positioned on the left side of the keyboard platform 12 with the sliding fitting 70 adjacent to the left end 26 of the groove.

Figure 11:
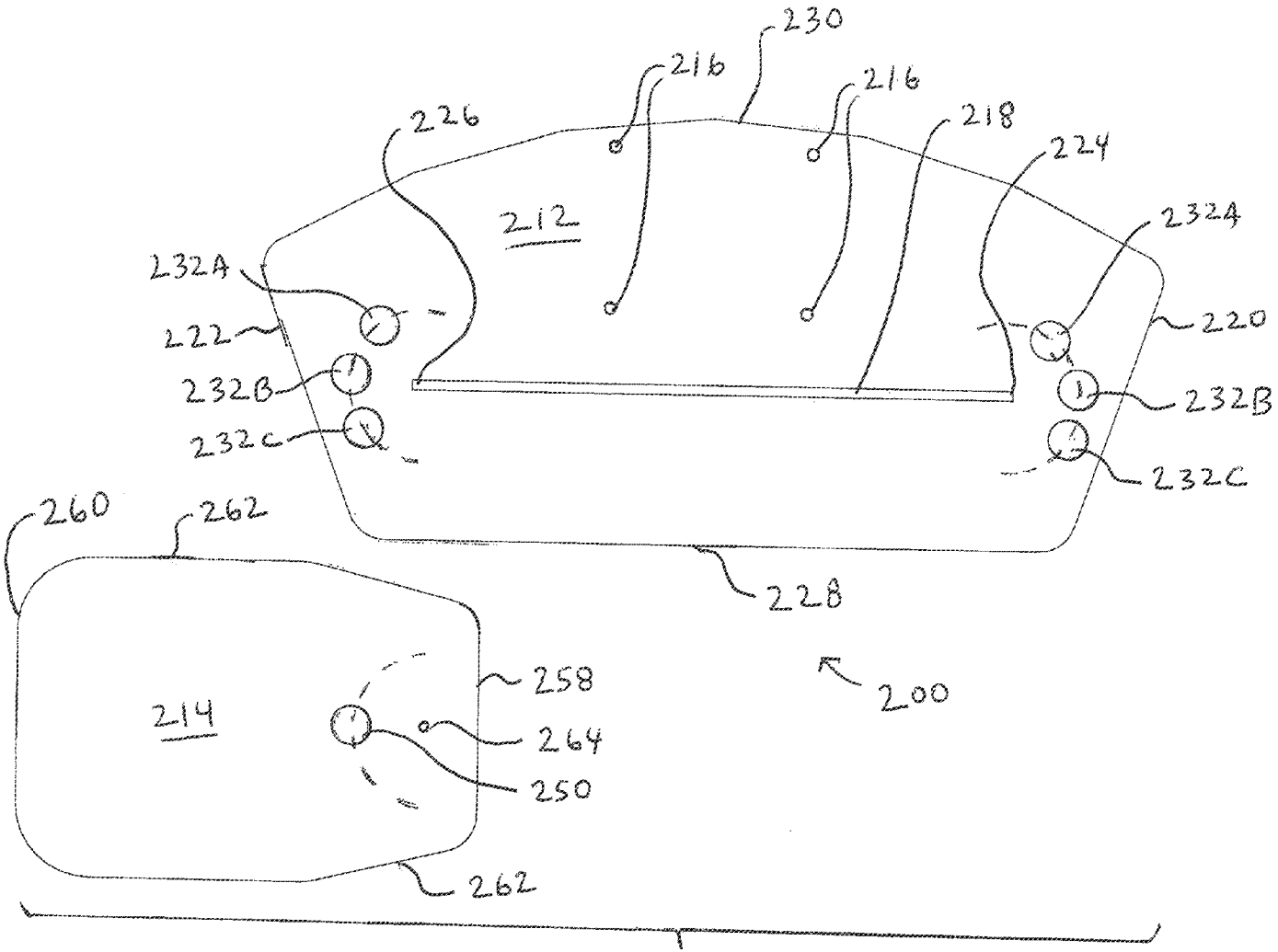
FIG. 11 is a top plan view of another exemplary embodiment of a keyboard platform and mouse platform that when assembled form a keyboard and sliding and swiveling mouse support of the invention.

FIG. 11 is a top plan view of another exemplary embodiment 200 of a keyboard platform 212 and mouse platform 214 that when assembled form a keyboard and sliding and swiveling mouse support 200 of the invention. The keyboard platform 212 comprises a generally flat section of material, such as high strength material, such as phenolic laminate, particle board, medium-density fibreboard (MDF), or plastic. This material provides sufficient strength, even at thicknesses as thin as ¼" (6 mm). A benefit of this material is that the thickness of the device is reduced, and this permits the keyboard and mouse support to be lowered more relative to a thicker platform such as formed of wood, particleboard, or other weaker materials.

Figure 12:
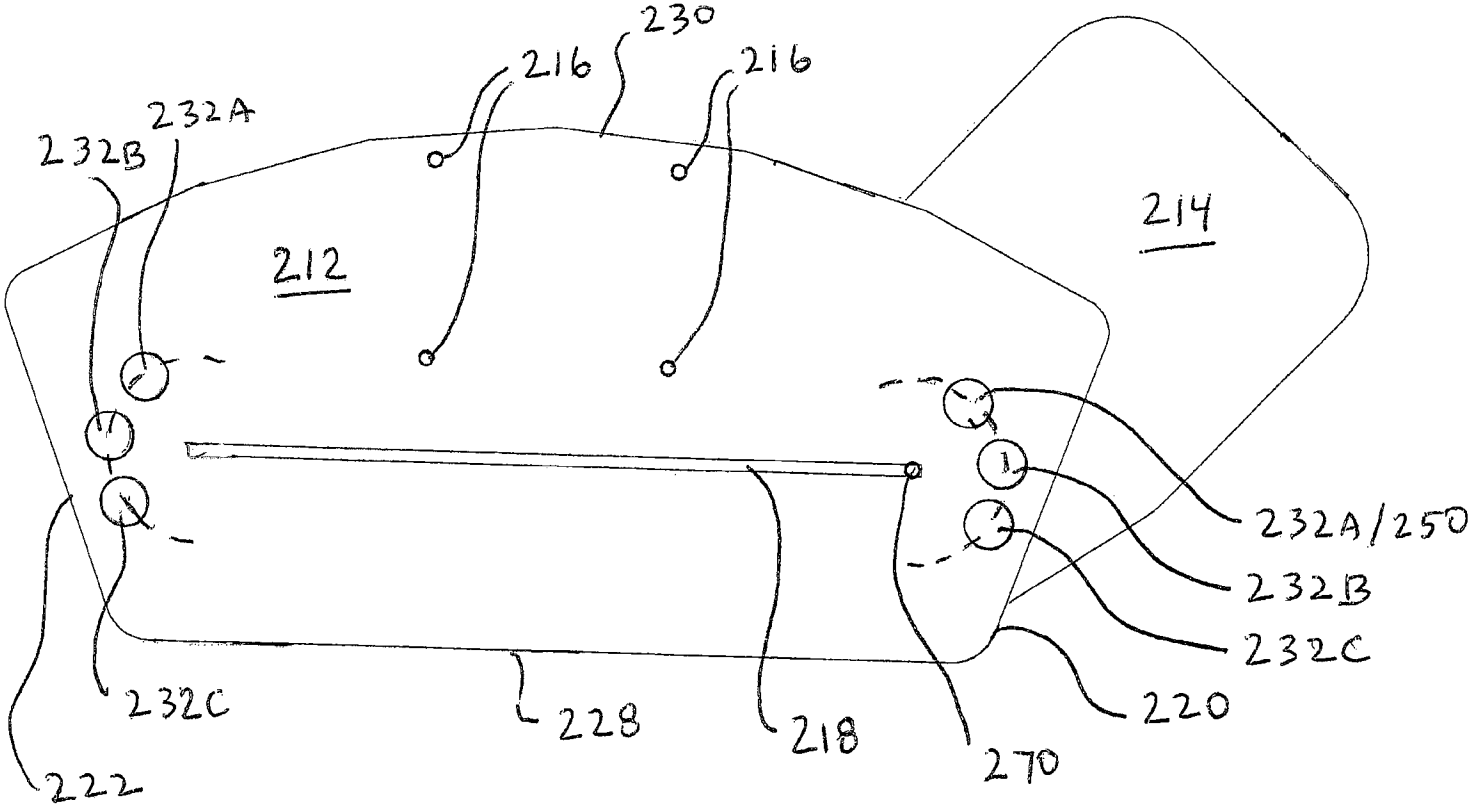
FIG. 12 is a top plan view of the assembled exemplary embodiment of the keyboard and sliding and swiveling mouse support of FIG. 11 with the mouse platform positioned on the right side and its rearmost position relative to the keyboard platform.
Figure 13:
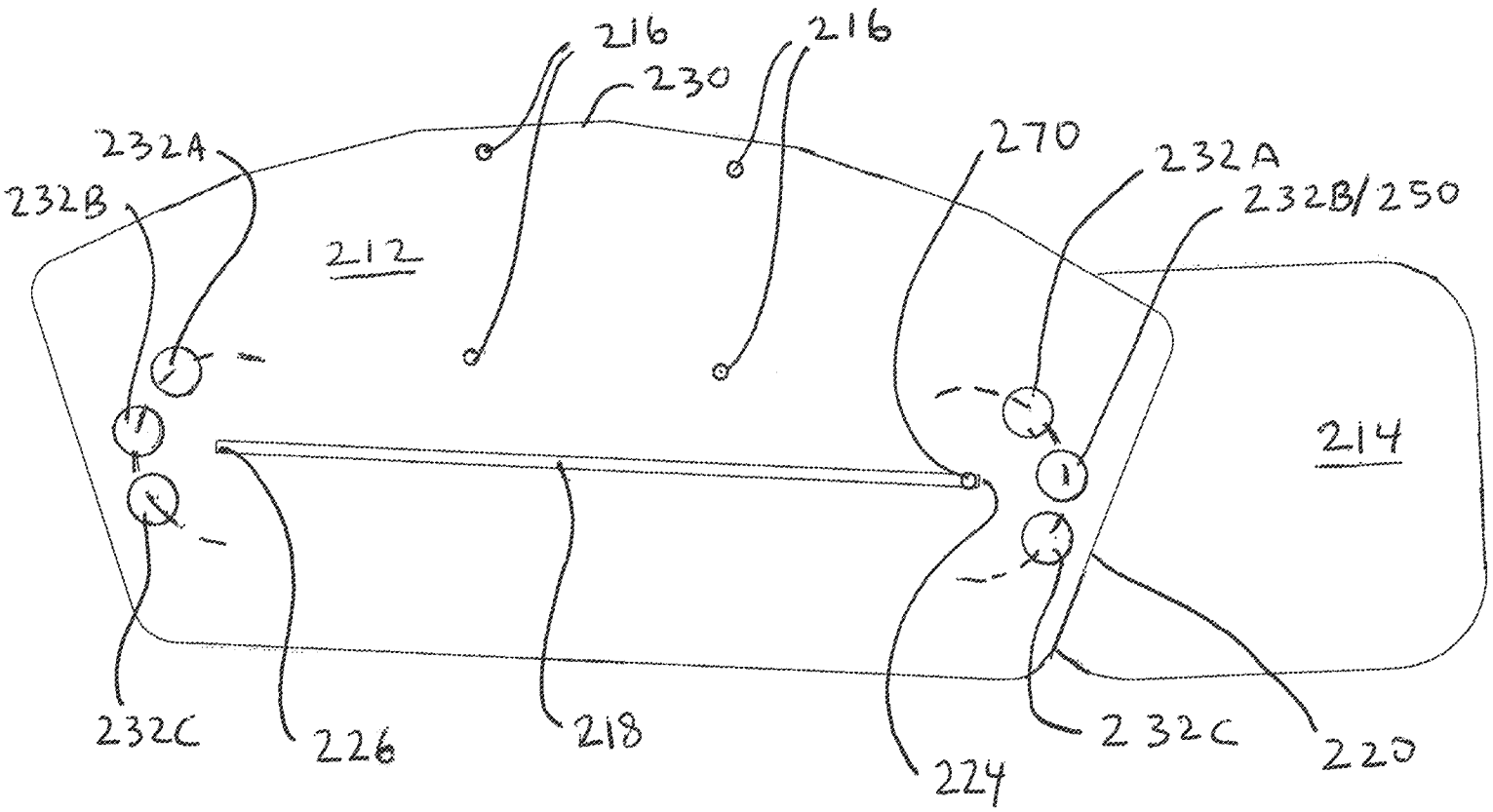
FIG. 13 is a top plan view of the assembled exemplary embodiment of the keyboard and sliding and swiveling mouse support of FIG. 11 with the mouse platform positioned on the right side and its middle position relative to the keyboard platform.
Figure 14:
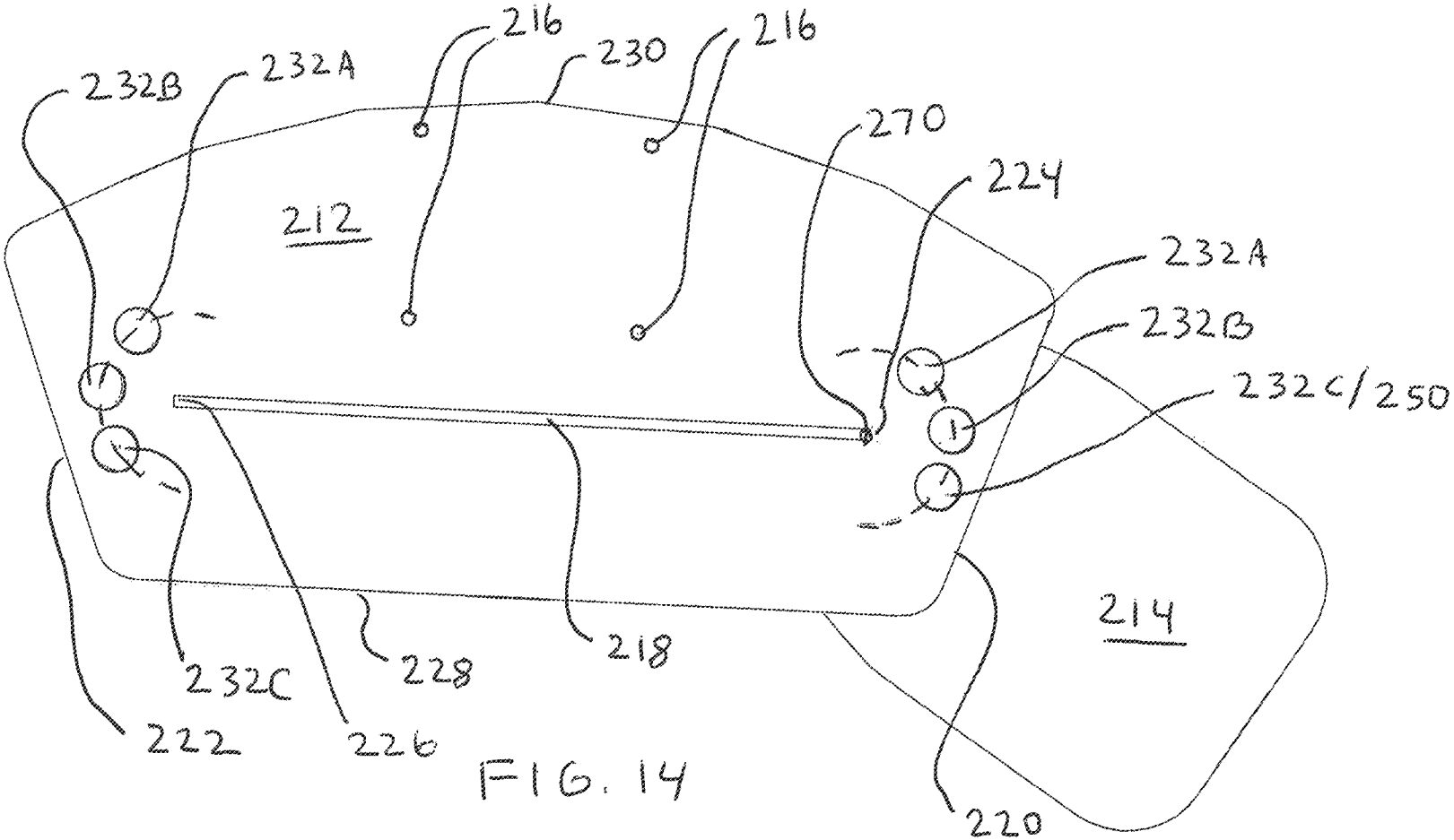
FIG. 14 is a top plan view of the assembled exemplary embodiment of the keyboard and sliding and swiveling mouse support of FIG. 11 with the mouse platform positioned on the right side and its frontmost position relative to the keyboard platform.

In order to permit the keyboard platform to be manipulated relative to a desktop or other surface via a keyboard arm (not shown), mounting holes 216 are preferably formed on the keyboard platform 212. Formed through the keyboard platform 212 is a longitudinal groove 218. The groove 218 extends across the width of the keyboard platform 212, from a right side 220 to a left side 222 thereof. The groove 218 has a right terminal end 224 and a left terminal end 226. The groove 218 is shown as being straight, but can follow other contours. The keyboard platform 212 has a front edge 228 and a rear edge 230. Although the rear edge 230 is shown as following a being generally curved or arched contour, it can be straight or follow other contours as desired. FIG. 11 shows a plurality of metal plates 232A, 232B, and 232C positioned in the keyboard platform 212 near the terminal ends 224 and 226 of the groove 218. The plurality of metal plates 232A, 232B, and 232C are preferably arranged along a circular pathway shown by the dashed line with a given radius that preferably corresponds to the distance that the center point of the magnet 250 is spaced away from the pivot 264 on the mouse platform 214. Thus, as shown in FIGS. 12-14, the magnet 250 in the mouse platform 214 can be aligned with a desired metal plate 232A, 232B, or 232C as shown in FIGS. 12, 13 and 14, respectively. While three metal plates 232A, 232B, and 232C are depicted, a greater number can likewise be used. For ease of description, the metal plates 232A, 232B, and 232C are shown as being revealed. However, as in the same manner as with respect to the embodiment of FIGS. 1-6, the metal plates 232A, 232B, and 232C are preferably retained in recesses formed in a bottom surface of the keyboard platform so as not to extend outwardly therefrom. The metal plates 232A, 232B, and 232C can be retained in the recesses by adhesive or can be mechanically attached, such as by screws, clips, or other known attachment devices. Although the metal plates 232A, 232B, and 232C are shown as being circular in shape, they can have other shapes if desired. The metal will preferably be a ferrous metal that attracts magnets. The mouse platform 214 comprises a generally flat section of material, such as high strength material, such as phenolic laminate, particle board, medium-density fibreboard (MDF), or plastic. This material provides sufficient strength, even at thicknesses as thin as ¼" (6 mm). The mouse platform 214 is shown as being generally rectangular, but can have other shapes if desired, such as generally circular, teardrop shaped, or other shapes (not shown). A permanent magnet 250 is located in the mouse platform 214. As with the embodiment of FIGS. 1-6, the magnet 250 is preferably retained in a recess formed in an upper surface of the mouse platform 214 so as not to extend outwardly therefrom. The magnet 250 can be retained in the recesses by adhesive or can be mechanically attached, such as by screws, clips, or other known attachment devices (not shown). In lieu of locating the metal plates 232A, 232B, and 232C in the keyboard platform 212 and the magnet 250 in the mouse platform 214, multiple magnets 250 can instead be placed in the keyboard platform 212 with a metal plate 232 located in the mouse platform 214. It is also possible that instead of using a magnet and metal plates, that magnets be placed in recesses in the keyboard platform aligned to attract the magnet 250 in the mouse platform 214. If this is the case, the two magnets will be aligned N-S or S-N so that they attract each other. The mouse platform 214 has an inside edge 258, an outside edge 260, and two opposed side edges 262. A pivot 264 is located on the mouse platform 214 between the magnet 250 and the inside edge 258. The pivot 264 can comprise a hole formed through the mouse platform 214, and can be sized to receive a sliding and pivoting fitting 270. The sliding and pivoting pivot 270 can comprise the same type of pivot as shown in FIGS. 4-7. The sliding and pivoting fitting 270 will allow the mouse platform 214 to both pivot in the groove 218 relative to keyboard platform 212, and also be moved from the left to the right side of the groove 218.

While the embodiment of FIGS. 11-15 shows a plurality of metal plates 232A, 232B, and 232C, it is also possible to utilize a greater or lesser number of plates. Furthermore, a plate having a general arc shape can likewise be used in lieu of multiple plates. Such a shape would allow an unlimited number of set positions of the mouse platform 214 relative to the keyboard platform 212.

FIG. 12 is a top plan view of the assembled exemplary embodiment of the keyboard and sliding and swiveling mouse support 200 of FIG. 11 with the mouse platform 214 positioned on the right side adjacent to the right edge 220 and its rearmost position relative to the keyboard platform 212. In this position, the magnet 250 in the mouse platform 214 is aligned below the metal plate 232A.

FIG. 13 is a top plan view of the assembled exemplary embodiment of the keyboard and sliding and swiveling mouse support 200 of FIG. 11 with the mouse platform 214 positioned on the right side adjacent to the right edge 220 and its middle position relative to the keyboard platform 212. In this position, the magnet 250 in the mouse platform 214 is aligned below the metal plate 232B.

FIG. 14 is a top plan view of the assembled exemplary embodiment of the keyboard and sliding and swiveling mouse support 200 of FIG. 11 with the mouse platform 214 positioned on the right side adjacent to the right edge 220 and its lower position relative to the keyboard platform 212. In this position, the magnet 250 in the mouse platform 214 is aligned below the metal plate 232C.

Figure 15:
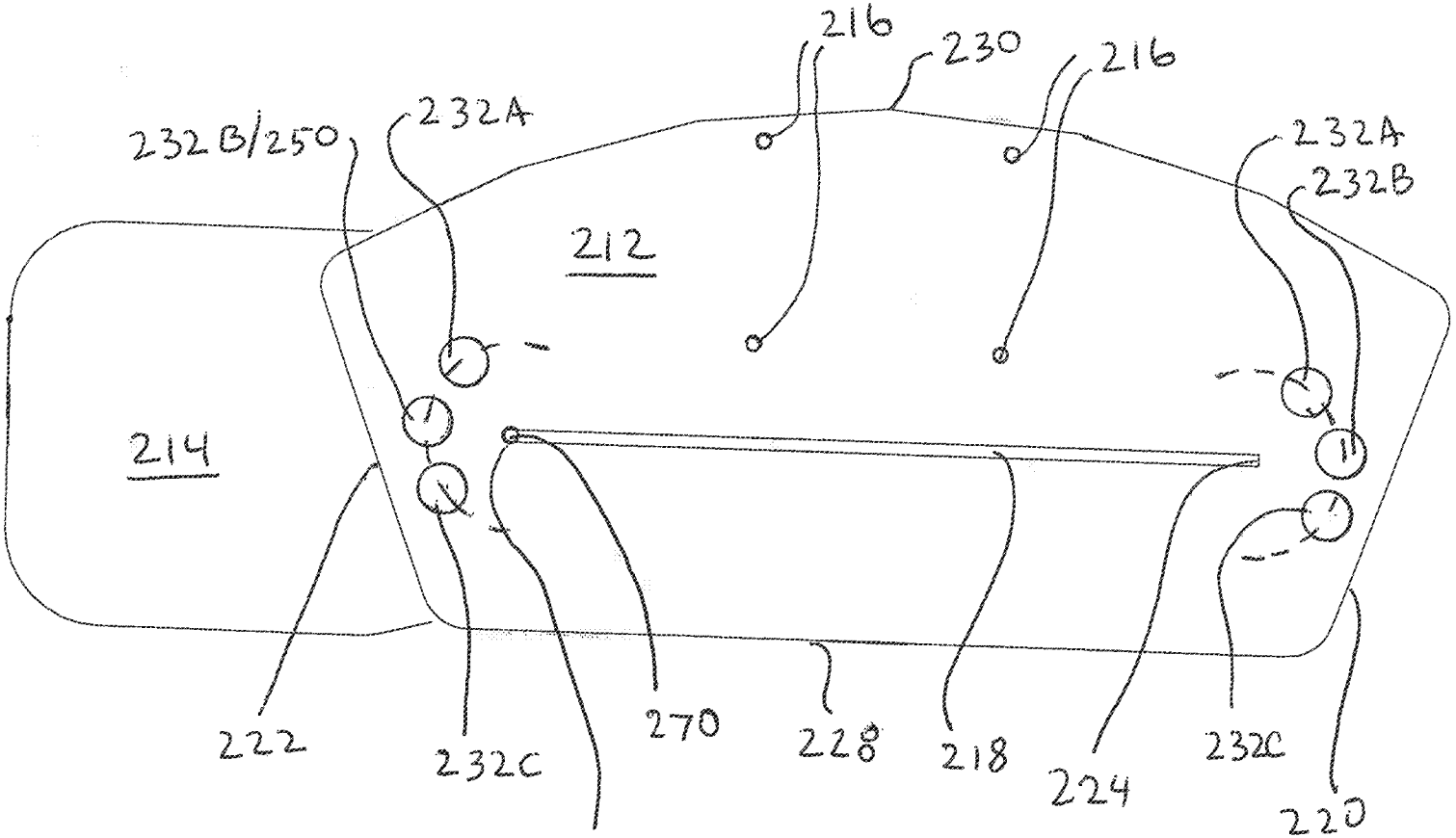
FIG. 15 is a top plan view of the assembled exemplary embodiment of the keyboard and sliding and swiveling mouse support of FIG. 11 with the mouse platform positioned on the left side and its middle position relative to the keyboard platform.

FIG. 15 is a top plan view of the assembled exemplary embodiment of the keyboard and sliding and swiveling mouse support 200 of FIG. 11 with the mouse platform 214 positioned on the left side adjacent to the left edge 222 and its middle position relative to the keyboard platform 212. In this position, the magnet 250 in the mouse platform 214 is aligned below the metal plate 232B.

With respect to both exemplary embodiment of the keyboard and sliding and swiveling mouse support 10 and 200, it is possible to forgo with the position retention mechanism using magnets and metal plates (or magnets and magnets) and use other position retention mechanisms.

Figure 16:
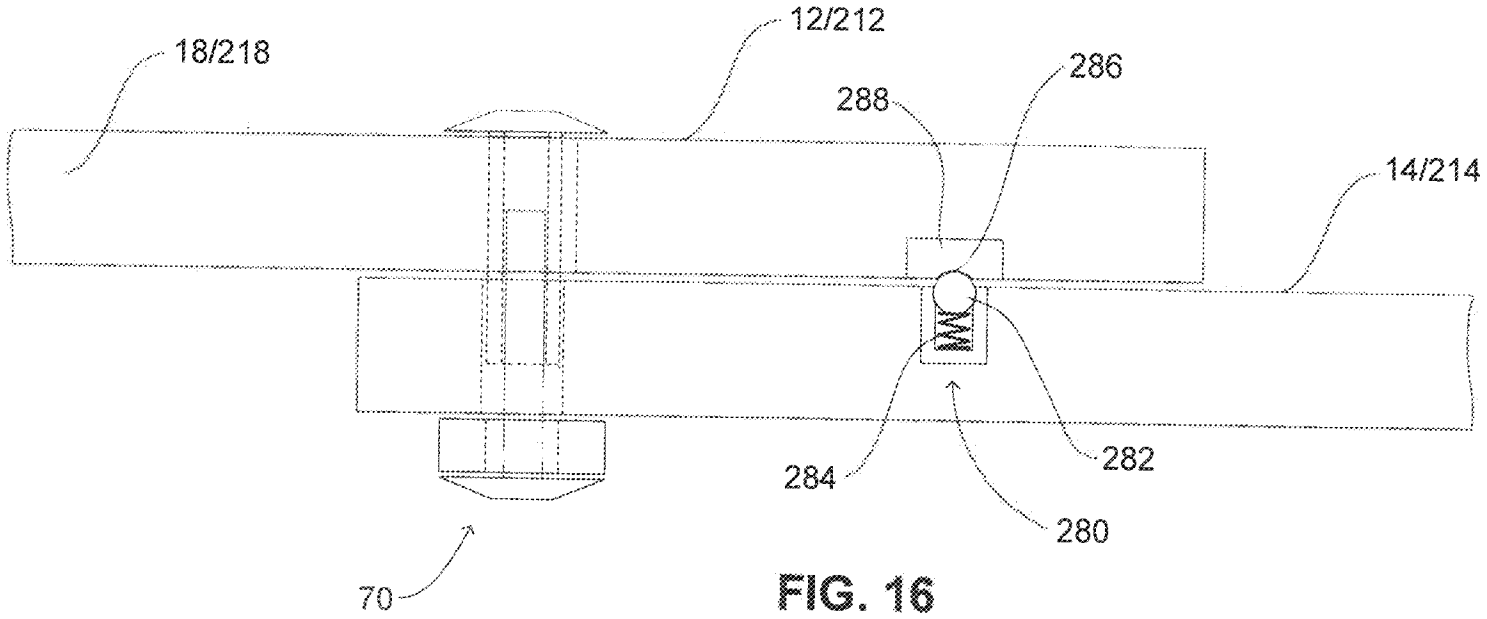
FIG. 16 is a detail showing another exemplary radial position fixation mechanism for the keyboard platform and mouse platform.

FIG. 16 shows another such radial position fixation mechanism, such as utilizing a spring clip mechanism 280 that includes a ball bearing 282 that is tensioned with a spring 284 and which engages with a recess 286, such as located in a plate 288. Rotating the mouse platform 14/214 relative to the keyboard platform 12/212 will cause the ball bearing 282 to move out of the recess 286 in the mouse platform 14/214. A single plate 288 can have multiple recesses (not shown) to accommodate different axial positions of the mouse platform 14/214 relative to the keyboard platform 12/212. Yet further position retention mechanisms can be used.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. A keyboard and mouse support, comprising:

a keyboard platform having a left side, a right side, an elongate slide extending across the keyboard platform from left to right, a bottom surface, a first keyboard platform recess formed in the bottom surface near the left side, and a second keyboard platform recess formed in the bottom surface near the right side;

a mouse platform having an upper surface, an inside edge, an outside edge, and two opposed sides, wherein a mouse platform recess is formed in the upper surface;

a pivot that pivotally connects the mouse platform to the keyboard platform; and a radial position fixation mechanism for setting at least one radial position of the mouse platform with respect to the keyboard platform, wherein the radial position fixation mechanism comprises a first fixation member received in the first keyboard platform recess, a second fixation member received in the second keyboard platform recess, and a third fixation member received in the mouse platform recess, wherein the first fixation member, the second fixation member, and the third fixation member are selected from the group consisting of:

(a) the first fixation member being a first magnet, the second fixation member being a second magnet, and the third fixation member being a metal plate, (b) the first fixation member being a first metal plate, the second fixation member being a second metal plate, and the third fixation member being a magnet, and (c) the first fixation member being a first magnet, the second fixation member being a second magnet, and the third fixation member being a third magnet;

wherein the pivot is slidably and pivotally received in the elongate slide and attaches to the mouse platform so that the mouse platform is configured to be moved between the left side and the right side of the keyboard platform by rotating the mouse platform on the pivot relative to the keyboard platform to flip the mouse platform around (a) so that when the mouse platform is on the left side of the keyboard platform, the outside edge of the mouse platform will extend outwardly from the left side of the keyboard platform, and the first fixation member received in the first keyboard platform recess near the left side of the keyboard platform and the third fixation member received in the mouse platform recess will be in alignment, thereby providing an exposed portion of the mouse platform adjacent to the outside edge of the mouse platform extending to the left side of the keyboard platform for use, and (b) so that when the mouse platform is on the right side of the keyboard platform, the outside edge of the mouse platform will extend outwardly from the right side of the keyboard platform, and the second fixation member received in the second keyboard platform recess near the right side of the keyboard platform and the third fixation member received in the mouse platform recess will be in alignment, thereby providing the exposed portion of the mouse platform adjacent to the outside edge of the mouse platform extending to the right side of the keyboard platform for use.

2. The keyboard and mouse support of claim 1, where the elongate slide comprises a groove formed through the keyboard platform that extends from left to right across the keyboard platform and stops short of the left side and the right side of the keyboard platform.

3. The keyboard and mouse platform of claim 1, wherein the bottom surface of the keyboard platform is generally flat and the upper surface of the mouse platform is generally flat.

4. The keyboard and mouse support of claim 3, wherein the pivot comprises a bolt and a screw, the pivot passes through a hole formed in the mouse platform and pivotally connects the mouse platform and the keyboard platform such that the upper surface of the mouse platform is in close and sliding contact with the bottom surface of the keyboard platform.

5. A keyboard and mouse support, comprising:

a keyboard platform with an elongate slide extending laterally across the keyboard platform from left to right, the elongate slide having a left end and a right end, the keyboard platform having a bottom surface, a left side, a right side, a first keyboard platform recess formed in the bottom surface near the left side, and a second keyboard platform recess formed in the bottom surface near the right side;

a mouse platform having an upper surface, an inside edge, an outside edge, and two opposed sides, wherein a mouse platform recess is formed in the upper surface, and the mouse platform further having a mouse radial position fixation mechanism received in the mouse platform recess; and a pivot pivotally connecting the mouse platform to the keyboard platform, the pivot slides and pivots in the elongate slide, wherein the pivot is positioned on the mouse platform between the mouse radial position fixation mechanism and the inside edge;

wherein the keyboard platform further comprises complementary radial position fixation mechanisms cooperating with the mouse radial position fixation mechanism for setting at least one radial position of the mouse platform with respect to the keyboard platform, the complementary radial position fixation mechanisms include a first complementary radial position fixation mechanism received in the first keyboard platform recess and a second complementary radial position fixation mechanism received in the second keyboard platform recess, wherein the mouse radial position fixation mechanism, the first complementary radial position fixation mechanism, and the second complementary radial position fixation mechanism are selected from the group consisting of:

(a) the mouse radial position fixation mechanism being a magnet, the first complementary radial position fixation mechanism being a first metal plate, and the second complementary radial position fixation mechanism being a second metal plate, (b) the mouse radial position fixation mechanism being a metal plate, the first complementary radial position fixation mechanism being a first magnet, and the second complementary radial position fixation mechanism being a second magnet, and (c) the mouse radial position fixation mechanism being a first magnet, the first complementary radial position fixation mechanism being a second magnet, and the second complementary radial position fixation mechanism being a third magnet;

wherein the pivot is slidably and pivotally received in the elongate slide and attaches to the mouse platform so that the mouse platform is configured to be moved between the left side and the right side of the keyboard platform by rotating the mouse platform on the pivot relative to the keyboard platform to flip the mouse platform around (a) so that when the mouse platform is on the left side of the keyboard platform, the outside edge of the mouse platform will extend outwardly from the left side of the keyboard platform, and the first complementary radial position fixation mechanism received in the first keyboard platform recess near the left side of the keyboard platform and the mouse radial position fixation mechanism received in the mouse platform recess will be in alignment, thereby providing an exposed portion of the mouse platform adjacent to the outside edge of the mouse platform extending to the left side of the keyboard platform for use, and (b) so that when the mouse platform is on the right side of the keyboard platform, the outside edge of the mouse platform will extend outwardly from the right side of the keyboard platform, and the second complementary radial position fixation mechanism received in the second keyboard platform recess near the right side of the keyboard platform and the mouse radial position fixation mechanism received in the mouse platform recess will be in alignment, thereby providing the exposed portion of the mouse platform adjacent to the outside edge of the mouse platform extending to the right side of the keyboard platform for use.

6. The keyboard and mouse platform of claim 5, wherein the bottom surface of the keyboard platform is generally flat, the upper surface of the mouse platform is generally flat, the pivot comprises a bolt and a screw, wherein the pivot passes through a hole formed in the mouse platform and pivotally connects the mouse platform and the keyboard platform such that the upper surface of the mouse platform is in close and sliding contact with the bottom surface of the keyboard platform.

* * * * *